US010738733B2

(12) United States Patent
Ikeda et al.

(10) Patent No.: US 10,738,733 B2
(45) Date of Patent: Aug. 11, 2020

(54) INTERNAL COMBUSTION ENGINE

(71) Applicant: TOYOTA JIDOSHA KABUSHIKI KAISHA, Aichi-ken (JP)

(72) Inventors: Naoya Ikeda, Susono (JP); Makoto Okawa, Susono (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/229,664

(22) Filed: Dec. 21, 2018

(65) Prior Publication Data

US 2019/0249619 A1 Aug. 15, 2019

(30) Foreign Application Priority Data

Feb. 14, 2018 (JP) ..... 2018-024121

(51) Int. Cl.
*F02F 7/00* (2006.01)
*F02B 75/20* (2006.01)
*F02B 75/18* (2006.01)

(52) U.S. Cl.
CPC ..... *F02F 7/0065* (2013.01); *F02B 75/20* (2013.01); *F02F 7/0007* (2013.01); *F02F 7/0053* (2013.01); *F02B 2075/1812* (2013.01)

(58) Field of Classification Search
CPC ..... F02F 7/0065; F02F 7/0007; F02F 7/0053; F02B 75/20; F02B 2075/1812
USPC ..... 123/58.1
See application file for complete search history.

(56) References Cited

U.S. PATENT DOCUMENTS 2,565,002 A * 8/1951 Bucher ..... F02B 25/00 123/73 V
4,362,132 A * 12/1982 Neuman ..... F02B 25/14 123/65 P
7,905,205 B1 * 3/2011 Parris ..... F02B 25/14 123/197.1
2011/0283964 A1 * 11/2011 Fujii ..... F02F 7/00 123/195 R
2017/0089423 A1 * 3/2017 Hucker ..... F16C 3/06

FOREIGN PATENT DOCUMENTS

JP 2002-180900 A 6/2002
JP 2010-84560 A 4/2010
JP 2010084560 A * 4/2010

* cited by examiner

*Primary Examiner* — Joseph J Dallo
*Assistant Examiner* — Yi-Kai Wang
(74) *Attorney, Agent, or Firm* — Hauptman Ham, LLP

(57) ABSTRACT

An internal combustion engine includes: a cylinder block including a bulkhead formed so as to separate adjacent cylinders; a crankshaft including a counterweight; and a gas-vent hole which is formed in the bulkhead within a radius of rotation of the counterweight when seen from below a piston bottom-dead-center position and an axial direction of the crankshaft, and which communicates between the adjacent cylinders. The counterweight includes at least one of a concave portion and a through-hole formed at at least a part of a region of the counterweight opposed to the gas-vent hole during rotation of the crankshaft. The concave portion hollows in a direction away from the gas-vent hole, the through-hole penetrating through the counterweight in a direction away from the gas-vent hole.

5 Claims, 5 Drawing Sheets

| | | | | |
|---|---|---|---|---|
| #1 | Expansion ↓ | Exhaust ↑ | Intake ↓ | Compression ↑ |
| #2 | Exhaust ↓ | Intake ↑ | Compression ↓ | Expansion ↑ |
| #3 | Compression ↑ | Expansion ↓ | Exhaust ↑ | Intake ↓ |
| #4 | Intake ↑ | Compression ↓ | Expansion ↑ | Exhaust ↓ |

180° 360° 540° 720°

INTERNAL COMBUSTION ENGINE

CROSS-REFERENCE TO RELATED APPLICATION

This application is based on and claims the benefit of Japanese Patent Application No. 2018-024121, filed on Feb. 14, 2018, which is incorporated by reference herein in its entirety.

BACKGROUND

Technical Field

The present disclosure relates to an internal combustion engine, and more particularly to an internal combustion engine equipped with a cylinder block including a gas-vent hole in a bulkhead that is formed so as to separate adjacent cylinders from each other.

Background Art

For example, JP 2010-084560 A discloses an in-line three-cylinder internal combustion engine equipped with a cylinder block including bulkheads formed so as to each separate adjacent cylinders from each other. In this engine, gas-vent holes (through holes) that each communicate between the adjacent cylinders are formed in the respective bulkheads at locations on the lower side of a piston bottom-dead-center position.

To be more specific, the gas-vent holes are provided at locations where they are periodically blocked by counterweights of a crankshaft during rotation of the crankshaft. On that basis, the gas-vent holes are arranged such that they are not blocked by the counterweights at or around a crank angle at which the speed of a piston in the relevant adjacent cylinder becomes highest in the course of this piston moving from the top dead center to the bottom dead center.

SUMMARY

If, when seen from the axial direction of a crankshaft, a gas-vent hole is arranged within the radius of rotation of a counterweight similarly to the internal combustion engine disclosed in JP 2010-084560 A, an internal combustion engine having the gas-vent hole can be downsized. However, according to the internal combustion engine disclosed in JP 2010-084560 A, the gas-vent holes are blocked by the counterweights in a crank angle range other than the above described crank angle range (i.e., at or around the crank angle at which the speed of the piston becomes highest in the course of this piston moving from the top dead center to the bottom dead center). Therefore, there is a possibility that the flow of gas between adjacent cylinders may be disturbed. In this way, according to the countermeasure that the gas-vent holes are arranged such that they are not blocked the counterweight in a specified crank angle range, there is a possibility that the flow of the gas between the adjacent cylinders may not be properly prevented from being disturbed.

The present disclosure has been made to address the problem described above, and an object of the present disclosure is to provide an internal combustion engine that can properly reduce the disturbance of the flow of gas between adjacent cylinders due to the fact that a gas-vent hole is blocked by a counterweight.

An internal combustion engine according to the present disclosure includes: a cylinder block including a bulkhead formed so as to separate adjacent cylinders; a crankshaft including a counterweight; and a gas-vent hole which is formed in the bulkhead within a radius of rotation of the counterweight when seen from below a piston bottom-dead-center position and an axial direction of the crankshaft, and which communicates between the adjacent cylinders. The counterweight includes at least one of a concave portion and a through-hole formed at at least a part of a region of the counterweight opposed to the gas-vent hole during rotation of the crankshaft. The concave portion hollows in a direction away from the gas-vent hole, the through-hole penetrating through the counterweight in a direction away from the gas-vent hole.

The internal combustion engine may be an in-line three-cylinder engine. The internal combustion engine may include a cylinder A arranged at an end of the cylinder block in a cylinder row direction. The at least one of the concave portion and the through-hole may be formed at the counterweight for the cylinder A. The at least one of the concave portion and the through-hole may be formed at the counterweight for the cylinder A in its region opposed to the gas-vent hole when a piston position of the cylinder A is within crank angle ranges of 20 to 175 and 220 to 325 degrees after bottom dead center.

The internal combustion engine may be an in-line three-cylinder engine. The internal combustion engine may include a cylinder A arranged at an end of the cylinder block in a cylinder row direction and a cylinder B arranged at a remaining end of the cylinder block in the cylinder row direction. The at least one of the concave portion and the through-hole may be formed at the counterweight for the cylinder B. The at least one of the concave portion and the through-hole may be formed at the counterweight for the cylinder B in its region opposed to the gas-vent hole when a piston position of the cylinder B is within crank angle ranges of −110 to −15 and 75 to 200 degrees after bottom dead center.

When seen from the axial direction of the crankshaft, the at least one of the concave portion and the through-hole may be formed so as to extend in an arc shape in a circumferential direction of the crankshaft.

With regard to a radial direction of the crankshaft, the at least one of the concave portion and the through-hole may be formed so as to entirely overlap with the gas-vent hole when seen from the axial direction of the crankshaft.

According to the internal combustion engine of the present disclosure, the counterweight includes at least one of the concave portion and the through-hole formed at at least a part of a region of the counterweight opposed to the gas-vent hole during rotation of the crankshaft. As a result, the flow of gas between adjacent cylinders through the gas-vent hole can be properly prevented from being disturbed by the counterweight.

DETAILED DESCRIPTION

Figure 1:
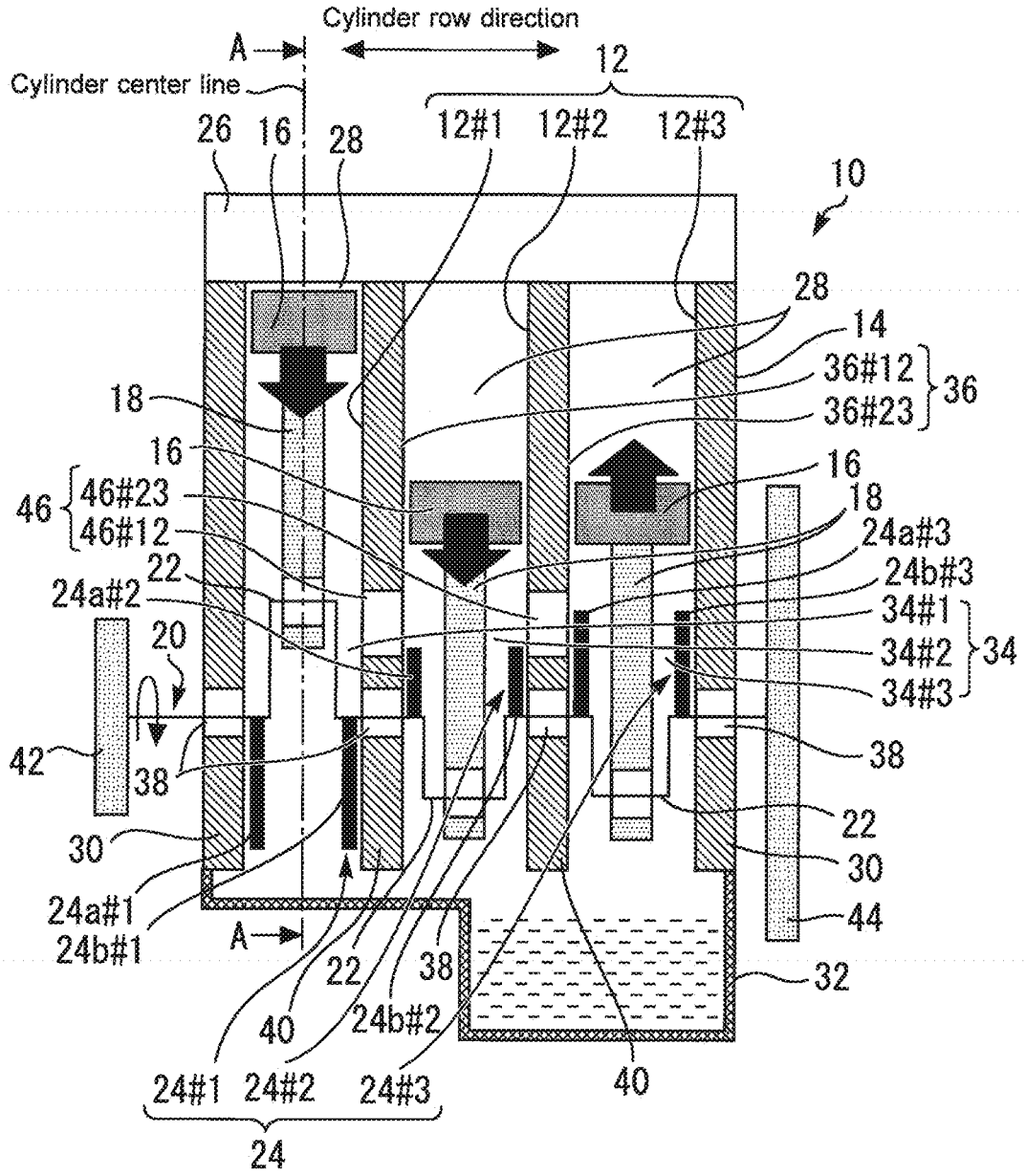
FIG. 1 is a schematic diagram for describing an example of the whole configuration of an internal combustion engine according to a first embodiment of the present disclosure.

In the following embodiments of the present disclosure, the same components in the drawings are denoted by the same reference numerals, and redundant descriptions thereof are omitted or simplified. Moreover, it is to be understood that even when the number, quantity, amount, range or other numerical attribute of an element is mentioned in the following description of the embodiments, the present disclosure is not limited to the mentioned numerical attribute unless explicitly described otherwise, or unless the present disclosure is explicitly specified by the numerical attribute theoretically. Furthermore, structures or the like that are described in conjunction with the following embodiments are not necessarily essential to the present disclosure unless explicitly shown otherwise, or unless the present disclosure is explicitly specified by the structures or the like theoretically.

First Embodiment

Firstly, a first embodiment according to the present disclosure and its modification examples will be described with reference to FIGS. 1 to 8.

1-1. Example of Whole Configuration of Internal Combustion Engine

FIG. 1 is a schematic diagram for describing an example of the whole configuration of an internal combustion engine 10 according to the first embodiment of the present disclosure. The internal combustion engine 10 shown FIG. 1 is an in-line three-cylinder engine. More specifically, the internal combustion engine 10 is provided with three cylinders 12 arranged in a row in the cylinder row direction. These cylinders 12 are formed inside a cylinder block 14. Hereunder, when describing each cylinder distinctively, three cylinders 12 are also referred to as a first cylinder 12#1, a second cylinder 12#2 and a third cylinder 12#3 in order from a position closer to an end portion of the internal combustion engine 10 (i.e., end portion located on the side opposite to a flywheel 44).

Pistons 16 are arranged in the respective cylinders 12. Each of the pistons 16 is coupled to a crank pin 22 of a crankshaft 20 via a connecting rod 18. The pistons 16 reciprocate inside the respective cylinders 12 in association with the rotation of the crankshaft 20. The crankshaft 20 is provided with counterweights 24 for balancing the crankshaft 20.

To be more specific, the counterweights 24#1, 24#2 and 24#3 for the respective cylinder 12 each include a pair or weight portions 24*a* and 24*b* (24*a*#1-24*a*#3, and 24*b*#1-24*b*#3). It should be noted that the configuration concerning the counterweights 24 of the crankshaft 20 is a characteristic portion of the present embodiment and will thus be described with reference to FIGS. 5 and 6.

A cylinder head 26 is arranged on the cylinder block 14. In addition, a combustion chamber 28 that is a space surrounded by the cylinder head 26, the cylinder block 14 and the piston 16 is formed atop the piston 16 in each cylinder 12.

On the other hand, a crankcase 30 is arranged under the cylinder block 14. In addition, an oil pan 32 for storing an oil that lubricates each portion of the internal combustion engine 10 is arranged under the crankcase 30. A crank chamber 34 that is a space surrounded by the cylinder block 14, the crankcase 30 and the oil pan 32 is formed on the side opposite to the combustion chamber 28 via the piston 16.

Moreover, the cylinder block 14 has a plurality of (in the example shown in FIG. 1, two) bulkheads 36 that are formed so as to separate the individual cylinders 12 inside the cylinder block 14. In more detail, the bulkheads 36 correspond to wall portions of the cylinder block 14 that are located on the lower side of the piston bottom-dead-center position. The crankshaft 20 is supported, via bearings 38, so as to be rotatable by the bulkheads 36 (cylinder block 14), the crankcase 30 and crank caps 40. The crank caps 40 for the respective cylinders 12 may be formed integrally with each other or formed separately from each other. It should be noted that a crank pulley 42 is attached to an end of the crankshaft 20. In addition, the flywheel 44 is attached to an end portion of the crankshaft 20 located on the side opposite to the crank pulley 42.

The crank chamber 34 communicates among three cylinders 12 at a location on the side closer to the oil pan 32. On the other hand, the crank chamber 34 is separated for each cylinder 12, by the bulkheads 36 and the crank caps 40, at a location on the side closer to the piston 16. The bulkheads 36 (36#12 and 36#23) each include gas-vent holes (communication holes 46 (46#12 and 46#23) that are formed for causing the crank chamber 34 to communicate between adjacent cylinders. The gas-vent holes 46 are formed in the respective bulkheads 36 below the piston bottom-dead-center position (in more detail, below the piston bottom-dead-center position and also in the vicinity of the respective cylinder bores).

In more detail, the gas-vent hole 46#12 for communicating between the crank chamber 34#1 of the first cylinder 12#1 and the crank chamber 34#2 of the second cylinder 12#2 is formed in the bulkhead 36#12 that separates the first cylinder 12#1 from the second cylinder 12#2. Also, the gas-vent hole 46#23 for communicating between the crank chamber 34#2 and the crank chamber 34#3 of the third cylinder 12#3 is formed in the bulkhead 36#23 that separates the second cylinder 12#2 from the third cylinder 12#3.

In addition to the above, the gas pressure in the crank chamber 34 is higher at a location closer to the cylinder bore. Moreover, if a gas-vent hole is formed at a location closer to the bottom end of the cylinder block 14, the gas-vent hole becomes easy to be blocked by the oil which is agitated. Thus, in order to reduce the pumping loss, it is more effective for the gas-vent hole to be arranged at a position closer to a cylinder bore similarly to the gas-vent holes 46 according to the present embodiment because the flow of the gas through the gas-vent hole can be smoothed.

1-2. Issue on Reduction of Pumping Loss 1-2-1. In-line Four-cylinder Engine (Comparative Example)

Figures 2, 3:
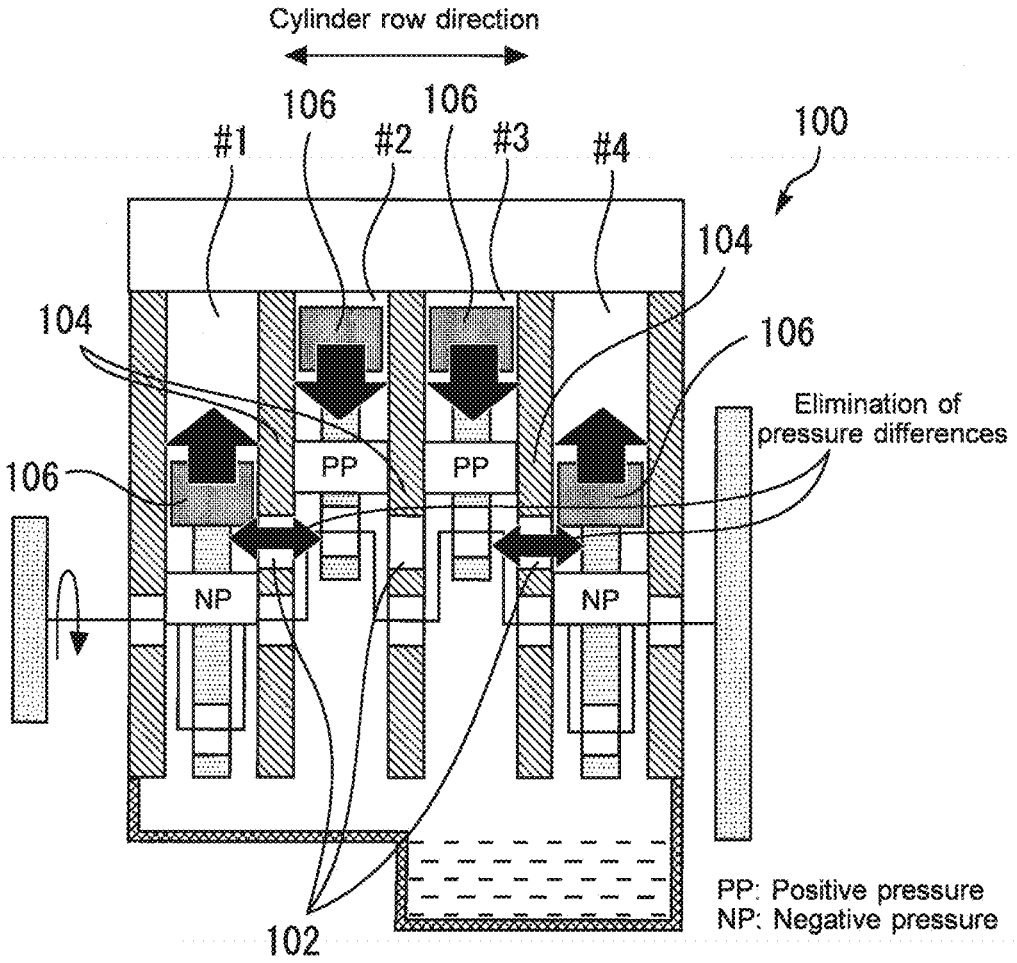
FIG. 2 is a schematic diagram for describing the operation of an in-line four-cylinder engine referred to for comparison with the internal combustion engine shown in FIG. 1 that is an in-line three-cylinder engine.
FIG. 3 is a diagram that illustrates a relationship between piston positions of the respective cylinders of the in-line four-cylinder engine and crank angle.

FIG. 2 is a schematic diagram for describing the operation of an in-line four-cylinder engine referred to for comparison with the internal combustion engine 10 that is an in-line three-cylinder engine. FIG. 3 is a diagram that illustrates a relationship between piston positions of the respective cylinders of the in-line four-cylinder engine and the crank angle.

An in-line four-cylinder internal combustion engine 100 shown in FIG. 2 is equipped with four cylinders #1-#4 that are arranged in a row in its cylinder row direction. In this internal combustion engine 100, gas-vent holes 102 for communicating between crank chambers of adjacent cylinders are formed in bulkheads 104 similarly to the gas-vent holes 46 of the internal combustion engine 10 shown in FIG. 1. In the internal combustion engine 100, a phase difference between a piston 106 in the cylinder (#1 or #4) arranged at an end in the cylinder row direction and a piston 106 of its adjacent cylinder (#2 or #3) is 180 degrees as shown in FIG. 3. In other words, in the internal combustion engine 100, there is no crank angle period in which the piston 106 in the cylinder #1 and the piston 106 in its adjacent cylinder #2 move in the same direction. This also applies to the relationship between the cylinder #3 and its adjacent cylinder #4.

Moreover, regardless of the number and arrangement of cylinders, when a piston ascends (i.e., when the piston moves from the bottom-dead-center side to the top-dead-center side), an in-crank-chamber pressure basically becomes negative at a location immediately under the piston, and, conversely, when the piston descends, the in-crank-chamber pressure basically becomes positive at the location immediately under the piston. More specifically, the negative pressure or the positive pressure that is produced in this way becomes higher at a location closer to the piston.

According to the internal combustion engine 100, a pressure difference between the negative pressure and positive pressure that is produced due to the ascent and descent of the piston as described above is produced between the adjacent cylinders as shown in FIG. 2. In the internal combustion engine 100, the phase difference between piston locations of each pair (#1 and #2, or #3 and #4) of adjacent cylinders is 180 degrees as described above. Because of this, as shown by arrows in FIG. 2, pressure differences produced in the respective pair of adjacent cylinders can be effectively eliminated by the use of the gas-vent holes 102.

In addition to the above, each arrow in FIG. 3 indicates gas flows from a cylinder on the positive pressure side (intake stroke and expansion stroke) to a cylinder on the negative pressure side (compression stroke and exhaust stroke). In this way, according to the in-line four-cylinder internal combustion engine 100, the gas can be caused to smoothly flow, by the use of the gas-vent holes 102 formed in the bulkheads 104, such that the pressure differences (pressure fluctuation) due to the ascent and descent of the pistons 106 are alternately released between the crank chambers of those adjacent cylinders. Because of this, reduction of the pumping loss is easy to be achieved by the use of the gas-vent holes 102.

Furthermore, according to the in-line four-cylinder internal combustion engine 100, counterweights required to balance its crankshaft becomes smaller as compared to that of an in-line three-cylinder internal combustion engine. Thus, in the internal combustion engine 100, it is hard to cause an issue that the flow of the gas is disturbed due to the fact that the gas-vent holes 102 are blocked by the counterweights. That is to say, the pumping loss is hard to increase due to this fact.

1-2-2. Issue in In-line Three-cylinder Engine

Figure 4:
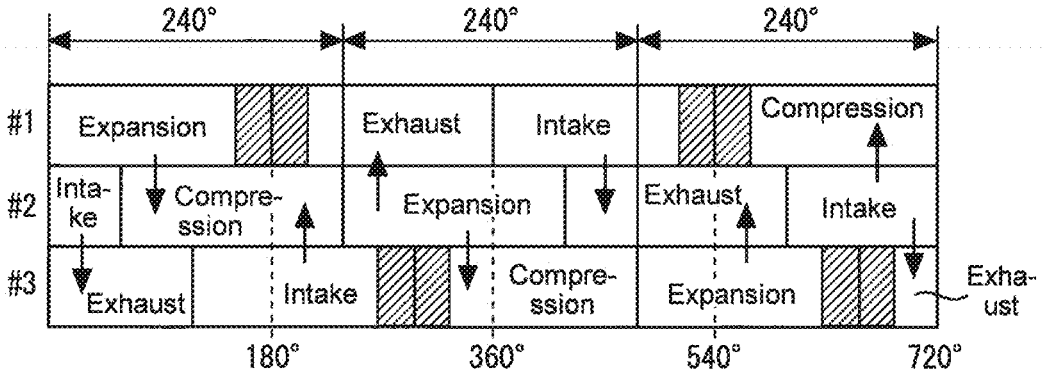
FIG. 4 is a diagram that illustrates a relationship between piston positions of the respective cylinders of an in-line three-cylinder engine and crank angle.

FIG. 4 is a diagram that illustrates a relationship between piston positions of the respective cylinders of an in-line three-cylinder engine and the crank angle. According to the in-line three-cylinder internal combustion engine, the phase difference between a piston in a cylinder (#1 or #3) arranged at an end in its cylinder row direction and a piston in its adjacent cylinder (#2) is 240 degrees as shown in FIG. 4.

According to the in-line three-cylinder engine similarly to the internal combustion engine 10 of the present embodiment, even under the same displacement volume per cylinder, counterweights required to balance the crankshaft becomes larger as compared to an in-line four-cylinder engine. In addition, in the in-line three-cylinder engine, the following countermeasure for the balancing described above is often done. This countermeasure is that counterweights for cylinders (#1 and #3) arranged at both the ends in the cylinder row direction are made larger than that for the center cylinder (#2).

In the in-line three-cylinder engine, gas-vent holes may be arranged within the radius of rotation of counterweights (in particular, cylinders (#1 and #3)) for downsizing (and also weight saving) of the internal combustion engine. If this kind of gas-vent holes are arranged, the gas-vent holes are blocked by the counterweights during the rotation of the crankshaft. As a result, there is a concern that, within a crank angle range in which the gas-vent holes are blocked by the counterweights, the pumping loss may increase due to the fact that the flow of gas between adjacent cylinders is disturbed. It should be noted that the hatching in FIG. 4 represents an example of this kind of crank angle width.

1-3. Characteristic Configuration According to First Embodiment

Figure 5:
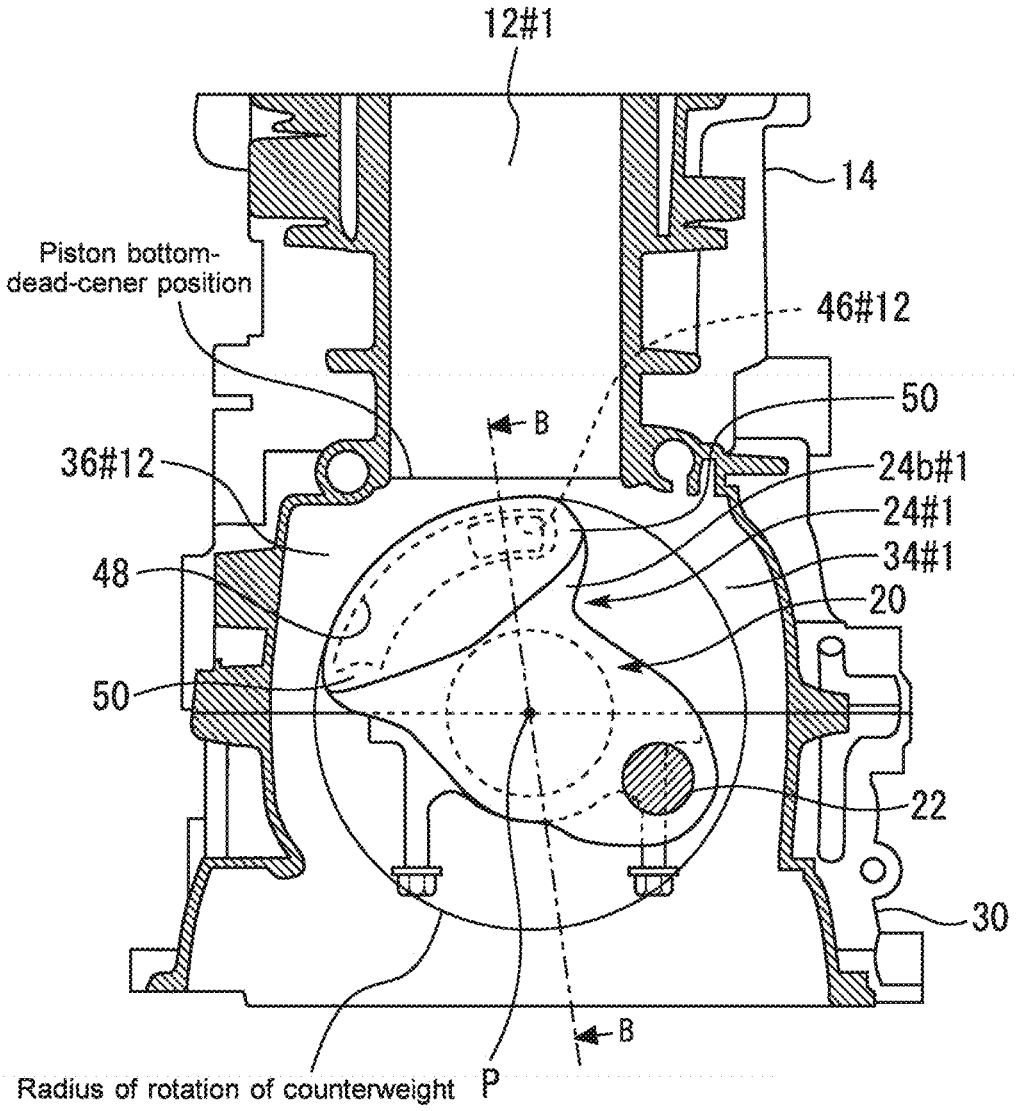
FIG. 5 is a cross-sectional view of a first cylinder.

FIG. 5 is a cross-sectional view of the first cylinder 12#1. In more detail, FIG. 5 corresponds to a cross-sectional view of A-A line in FIG. 1, that is, a cross-sectional view of the internal combustion engine 10 cut along a plane which contains a cylinder center line of the first cylinder 12#1 (see FIG. 1) and which is orthogonal to the center axial line of the crankshaft 20. Because of this, FIG. 5 represents the weight portion 24*b*#1 of the counterweight 24#1 for the first cylinder 12#1, which is located on the side closer to the second cylinder 12#2.

In the example of the internal combustion engine 10 according to the present embodiment, similarly to the in-line three-cylinder engine exemplified in the explanation of the issue described above, the countermeasure that the counterweights 24#1 and 24#3 for the first cylinder 12#1 and the third cylinder 12#3 are made larger than the counterweight 24#2 for the second cylinder 12#2 is taken.

Moreover, as shown in FIG. 5, according to the internal combustion engine 10 of the present embodiment, the gas-vent hole 46#12 that is formed in the bulkhead 36#12 that separates the first cylinder 12#1 from the second cylinder 12#2 is arranged within the radius of rotation of the counterweight 24#1 for the first cylinder 12#1 (more specifically, the radius of rotation of an end of the counterweight 24#1 located on the outside in the radial direction of the crankshaft 20). As a result, as shown in FIG. 5, a crank angle range in which, when seen from the axial direction of the crankshaft 20, the gas-vent hole 46#12 overlaps with (the weight portion 24*b*#1 of) the counterweight 24#1 is seen during rotation of the crankshaft 20. This also applies to a relationship between the third cylinder 12#3 and the second cylinder 12#2, although its illustration is omitted.

Figure 6:
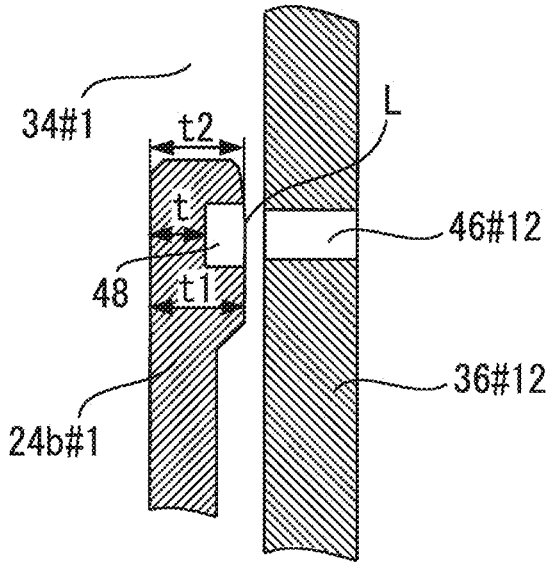
FIG. 6 is a cross-sectional view of B-B line in FIG. 5.

FIG. 6 is a cross-sectional view of B-B line in FIG. 5. More specifically, FIG. 6 represents the weight portion 24*b*#1 and the bulkhead 36#12 cut along a plane that passes through the gas-vent hole 46#12 and the axial center P of the crankshaft 20 when, in the view of the cylinder block 14 from the axial direction of the crankshaft 20, the weight portion 24*b*#1 and the gas-vent hole 46#12 overlap with each other.

As shown in FIGS. 5 and 6, the weight portion 24*b*#1 of the counterweight 24#1 is provided with a concave portion 48. The concave portion 48 is formed on the weight portion 24*b*#1 in a region in which the weight portion 24*b*#1 is opposed to the gas-vent hole 46#12 (i.e., region in which the weight portion 24*b*#1 overlaps with the gas-vent hole 46#12 when seen from the axial direction of the crankshaft 20) during rotation of the crankshaft 20. As shown in FIG. 6, the concave portion 48 is formed so as to hollow in a direction away from the gas-vent hole 46#12. In more detail, the concave portion 48 hollows in a direction away from the gas-vent hole 46#12 with respect to a line L that shows a base shape of the weight portion 24*b*#1.

A region of a broken line indicated by a reference sign 48 in FIG. 5 shows an example of a region of formation of the concave portion 48. In the example shown in FIG. 5, with regard to the radial direction of the crankshaft 20, the concave portion 48 is formed so as to entirely overlap with the gas-vent hole 46#12 when seen from the axial direction of the crankshaft 20. In addition, the width of the concave portion 48 in the radial direction of the crankshaft 20 is wider than that of the gas-vent hole 46#12 in the same direction.

Moreover, with regard to the circumferential direction of the crankshaft 20, the concave portion 48 is formed so as to exist over the whole counterweight 24#1. In more detail, with regard to the circumferential direction, the concave portion 48 is formed so as to extend in the shape of arc that centers on the axial center P of the crankshaft 20 when seen from the axial direction of the crankshaft 20. It should be noted that, in the example shown in FIG. 5, both ends of the concave portion 48 in the circumferential direction of the crankshaft 20 are blocked by a wall portion 50 of the counterweight 24#1. However, contrary to this example, one or both of the end portions of the concave portion 48 in the circumferential direction of the crankshaft 20 may alternatively be open (that is, the wall portion 50 may not be provided).

Furthermore, with respect to the axial direction of the crankshaft 20 (i.e., depth direction of the concave portion 48), the depth of the concave portion 48 is not particularly limited. However, the depth of the concave portion 48 may be defined, for example, as follows.

That is to say, the depth of the concave portion 48 may be set, for example, so as to be greater than or equal to a value obtained by multiplying, by one-third, an average value of the sum of a thickness t1 of the weight portion 24*b*#1 at an end of the concave portion 48 in the radial direction of the crankshaft 20 and a thickness t2 of the weight portion 24*b*#1 at the remaining end thereof (i.e., average depth=(t1+t2)/2), as shown in FIG. 6. The greater the depth of the concave portion 48 is, the greater the volume of the concave portion 48 becomes. Thus, in order to reduce the disturbance of the flow of the gas by the counterweight 24#1, it is favorable to make greater the depth of the concave portion 48 because the flow of the gas around the gas-vent hole 46#13 can be more effectively distributed by the use of the concave portion 48. Therefore, in order to more effectively reduce the disturbance of the flow of the gas, it is favorable to set the depth of the concave portion 48 such that it becomes greater than or equal to one-third of the average thickness described above.

A concave portion similar to the concave portion 48 is formed in the weighting portion 24*a*#3 of the counterweight 24#3 for the third cylinder 12#3, which is located on the side closer to the second cylinder 12#2, although the illustration thereof is omitted.

1-4. Advantageous Effects of Characteristic Configuration According to First Embodiment Firstly, as a premise, according to the internal combustion engine 10, the gas-vent holes 46#12 and 46#23 are respectively arranged within the respective radiuses of rotation of the counterweight 24#1 of the first cylinder 12#1 and the counterweight 24#3 of the third cylinder 12#3. In this way, the downsizing (and also the weight saving) of the internal combustion engine 10 is achieved.

On that basis, according to the internal combustion engine 10 of the present embodiment, for the weight portion 24*b*#1 of the counterweight 24#1 located on the side of the adjacent cylinder (second cylinder 12#2), the concave portion 48 is formed in a region of the weight portion 24*b*#1 that is opposed to the gas-vent hole 46#12 during rotation of the crankshaft 20. Thus, a greater space can be ensured between the gas-vent hole 46#12 and the wall surface of the weight portion 24*b*#1 that is opposed to the gas-vent hole 46#12, as compared to an example without the concave portion 48. This makes it possible to prevent the flow of the gas from being disturbed by the counterweight 24#1 between the adjacent cylinders (i.e., between the crank chamber 34#1 and the crank chamber 34#2) through the gas-vent hole 46#12. This also applies to the third cylinder 12#3 in which a concave portion similar to the concave portion 48 is formed on the weight portion 24*a*#3 located on the side closer to the second cylinder 12#2 that is the adjacent cylinder for the third cylinder 12#3.

As described so far, the internal combustion engine 10 according to the present embodiment can properly prevent the flow of the gas from being disturbed by each gas-vent hole 46 that is blocked by the counterweight 24 between the adjacent cylinders. Therefore, the pumping loss of the internal combustion engine 10 can be reduced while achieving the downsizing (and also the weight saving) thereof.

1-5. Modification Examples Concerning First Embodiment

In the first embodiment described above, with regard to the circumferential direction of the crankshaft 20, the concave portion 48 is formed so as to exist over the whole counterweight 24#1 (this also applies to the concave portion for the third cylinder 12#3) as shown in FIG. 5. However, the region of formation of the concave portion in the circumferential direction of the crankshaft according to the present disclosure may be determined, for example, as follows.

Figure 7:
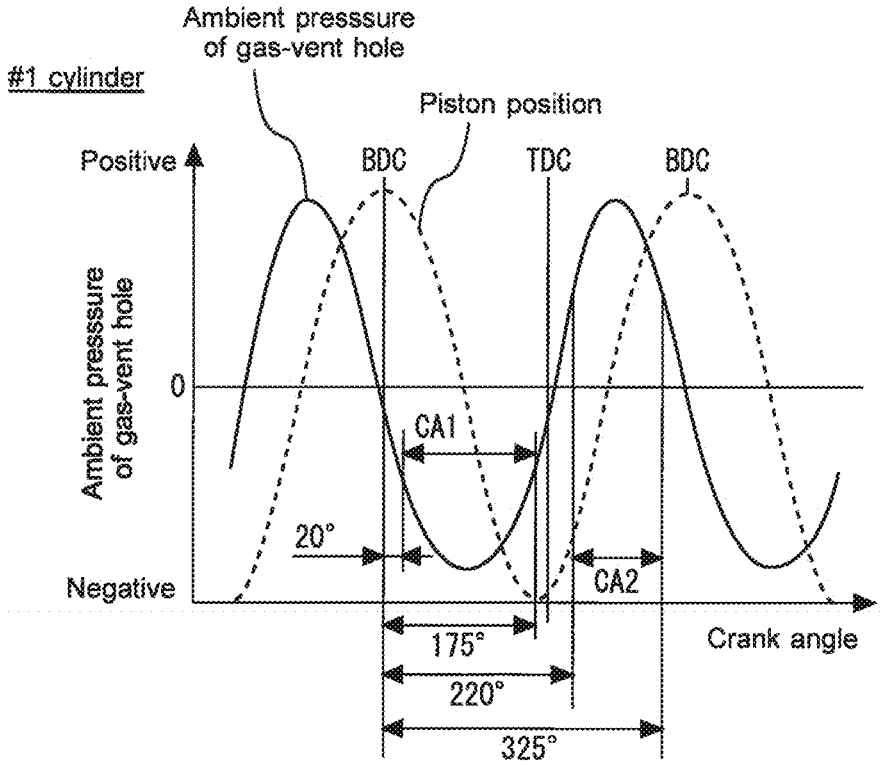
FIG. 7 is a graph that illustrates a relationship (examination results) between the piston position at the first cylinder of the internal combustion engine shown in FIG. 1 and the ambient pressure of a gas-vent hole, and the crank angle.

FIG. 7 is a graph that illustrates a relationship (examination results) between the piston position at the first cylinder 12#1 of the internal combustion engine 10 and the ambient pressure of the gas-vent hole 46#12, and the crank angle. It should be noted that the ambient pressure of the gas-vent hole 46#12 mentioned here corresponds to a gas pressure near the gas-vent hole 46#12 in the crank chamber 34#1 of the first cylinder 12#1.

As shown in FIG. 7, the ambient pressure of the gas-vent hole 46#12 becomes negative in the process from the bottom dead center (BDC) toward the top dead center (TDC) (that is, process in which the piston 16 ascents toward the top dead center). A crank angle range CA1 in FIG. 7 corresponds to a crank angle range in which the ambient pressure is negative and lower than or equal to a predetermined level. In detail, the crank angle range CA1 is a range from 20 to 175 degrees after bottom dead center concerning the piston position at the first cylinder 12#1.

On the other hand, the ambient pressure becomes positive in the process from the top dead center toward the bottom dead center (that is, process in which the piston 16 descents toward the bottom dead center). A crank angle range CA2 in FIG. 7 corresponds to a crank angle range in which the ambient pressure is positive and higher than or equal to a predetermined level. In detail, the crank angle range CA2 is a range from 220 to 325 degrees after bottom dead center concerning the piston position at the first cylinder 12#1.

When seen from the axial direction of the crankshaft 20, if the weight portion **24*b*#1 of the counterweight 24#1 overlaps with the gas-vent hole 46#12 at a part of the crank angle ranges CA1 and CA2 described above, the flow of the gas around the gas-vent hole 46#12 becomes easy to be disturbed by the weight portion 24*b*#1. Thus, in this kind of situation, it would be favorable that the concave portion is formed for the region of the weight portion 24*b*#1 that overlaps with the gas-vent hole 46#12 in the crank angle ranges CA1 and CA2. In other words, it would be favorable that the concave portion is formed in the region of the weight portion 24*b*#1 that is opposed to the gas-vent hole 46#12 when the piston position at the first cylinder 12#1 is within the crank angle range CA1 or CA2**.

In view of the knowledge described with reference to FIG. 7, the concave portion of the weight portion **24*b*#1 for the first cylinder 12#1 may be formed on, for example, only the whole region of the weight portion 24*b*#1 that is opposed to the gas-vent hole 46#12 when the piston position at the first cylinder 12#1 (which corresponds to an example of the "cylinder A" according to the present disclosure) is within the crank angle range CA1 or CA2, instead of the example of the concave portion 48. Alternatively, the concave portion may be formed on only a part of the region of the weight portion 24*b*#1 that is opposed to the gas-vent hole 46#12 when the piston position at the first cylinder 12#1 is within the crank angle range CA1 or CA2. However, with regard to the improvement of the flow of the gas, it can be expected that a wider region of formation of the concave portion in the circumferential direction of the crankshaft 20 achieves a greater advantageous effects because the volume of the concave portion becomes greater. Additionally, in relation to the explanation of FIG. 7, it can be said that the example of the concave portion 48 according to the first embodiment (i.e., example in which the concave portion is formed so as to exist over the whole weight portion 24*b*#1 in the circumferential direction of the crankshaft 20) corresponds to, with regard to the circumferential direction, an example in which a concave portion is formed in not only a region associated with the crank angel ranges CA1 and CA2** but also a region associated with a crank angle range in the vicinity thereof.

Figure 8:
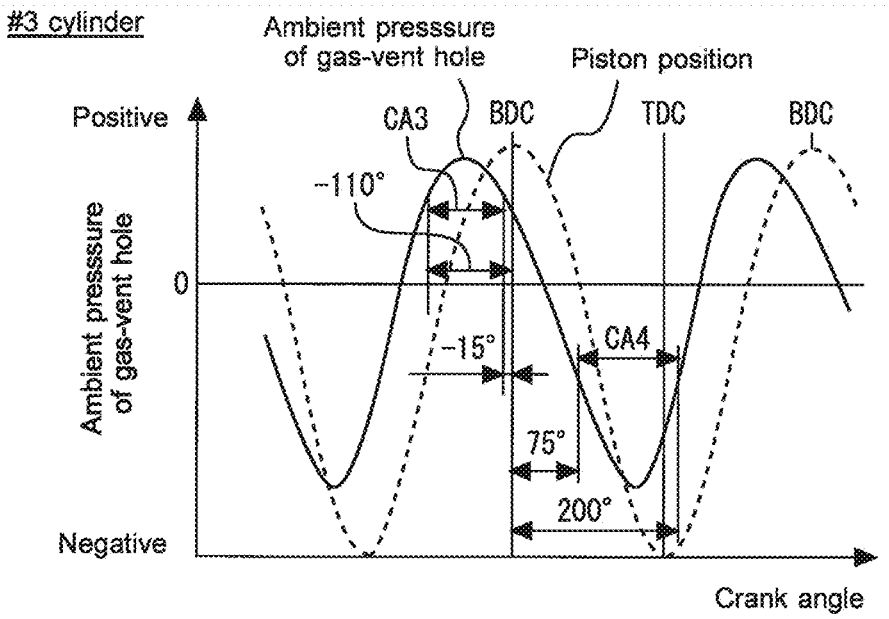
FIG. 8 is a graph that illustrates a relationship between the piston position at a third cylinder of the internal combustion engine shown in FIG. 1 and the ambient pressure of a gas-vent hole, and the crank angle.

On the other hand, FIG. 8 is a graph that illustrates a relationship between the piston position at the third cylinder 12#3 of the internal combustion engine 10 and the ambient pressure of the gas-vent hole 46#23 (i.e., gas pressure near the gas-vent hole 46#23 in the crank chamber 34#3 of the third cylinder 12#3), and the crank angle.

As shown in FIG. 8, with regard to the third cylinder 12#3, similarly to the first cylinder 12#1, crank angle ranges CA3 and CA4 are present. The crank angle range CA3 corresponds to a crank angle range in which the ambient pressure is negative and lower than or equal to a predetermined level, and, more specifically, is a range from −110 to −15 degrees after bottom dead center regarding the piston position at the third cylinder 12#3. Furthermore, the crank angle range CA4 corresponds to a crank angle range in which the ambient pressure is positive and higher than or equal to a predetermined level, and, more specifically, is a range from 75 to 200 degrees after bottom dead center regarding the piston position at the third cylinder 12#3.

Accordingly, another example of the concave portion formed in the counterweight **24*b*#3 for the third cylinder 12#3 may be as follows, similarly to above-described another example of the concave portion for the first cylinder 12#1 associated with the explanation of FIG. 7. That is to say, the concave portion of the counterweight 24*b*#3 may alternatively, be formed on, for example, only the whole region of the counterweight 24*b*#3 that is opposed to the gas-vent hole 46#23 when the piston position at the third cylinder 12#3 (which corresponds to an example of the "cylinder B" according to the present disclosure) is within the crank angle range CA3 or CA4. Alternatively, the concave portion may be formed in only a part of the region of the counterweight 24*b*#3 that is opposed to the gas-vent hole 46#23 when the piston position at the third cylinder 12#3 is within the crank angle range CA3 or CA4**.

It should be noted that the modification examples described above may also be applied to counterweights in which through-holes are formed instead of the concave portions as in the following second embodiment.

Second Embodiment

Next, a second embodiment according to the present disclosure will be described with reference to FIG. 9.

2-1. Characteristic Configuration According to Second Embodiment

Figure 9:
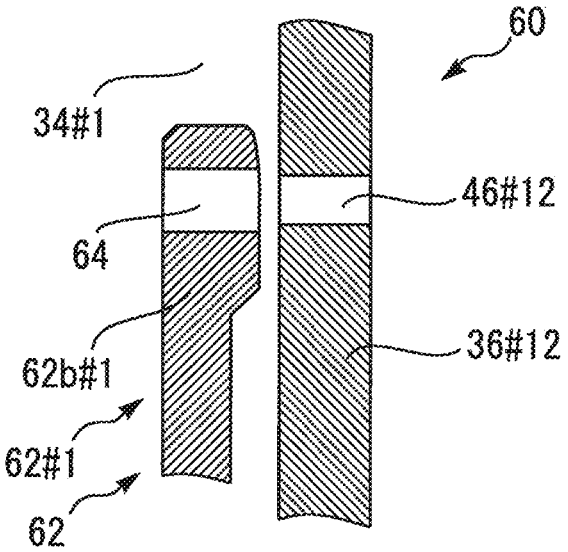
FIG. 9 is a schematic diagram for describing the characteristic configuration according to a second embodiment of the present disclosure.

FIG. 9 is a schematic diagram for describing the characteristic configuration according to the second embodiment of the present disclosure, and represents a cross-section of the first cylinder 12#1 similarly to FIG. 5. An internal combustion engine 60 according to the present embodiment is different from the internal combustion engine 10 according to the first embodiment in terms of the configuration of counterweights 62 being different from the configuration of the counterweights 24.

More specifically, the base shape of the counterweights 62 are the same as that of the counterweights 24 according to the first embodiment. On that basis, as shown in FIG. 9, a through-hole 64 is formed in a weight portion **62*b*#1 of a counterweight 62#1 for the first cylinder 12#1 located on the side closer to the second cylinder 12#2, instead of the concave portion 48. The through-hole 64 is formed in a region of the weight portion 62***b*#1 that is opposed to the gas-vent hole 46#12 during rotation of the crankshaft 20, similarly to the concave portion 48. The through-hole 64 penetrates through the counterweight 62*b*#1 in a direction away from the gas-vent hole 46#12.

Moreover, with regard to the radial direction of the crankshaft 20, the through-hole 64 is formed so as to overlap with the whole gas-vent hole 46#12 when seen from the axial direction of the crankshaft 20, similarly to the concave portion 48. Furthermore, with regard to the circumferential direction of the crankshaft 20, the through-hole 64 is formed so as to exist over the whole weighting portion 62*b*#1 (in more detail, so as to extend in the shape of arc that centers on the axial center P of the crankshaft 20 when seen from the axial direction of the crankshaft 20) similarly to the concave portion 48 as an example, although the illustration thereof is omitted.

Furthermore, a through-hole similar to the through-hole 64 is formed in a weight portion of counterweights for the third cylinder 12#3, which is located on the side closer to the second cylinder 12#2, although the illustration thereof is omitted.

2-2. Advantageous Effects Concerning Characteristic Configuration According to Second Embodiment According to the internal combustion engine 60 provided with the counterweights 62 having the through-hole 64, a greater space can also be ensured between the gas-vent hole 46#12 and the wall surface of the weight portion 24*b*#1 that is opposed to the gas-vent hole 46#12, as compared to an example without the through-hole 64. This makes it possible to prevent the flow of the gas from being disturbed by the counterweight 62#1 between the adjacent cylinders (i.e., between the crank chamber 34#1 and the crank chamber 34#2) through the gas-vent hole 46#12. In particular, by the use of the through-hole 64 instead of the concave portion 48, the flow of the gas through the gas-vent hole 46#12 becomes possible to more effectively improved because the gas can pass through the through-hole 64. In addition, this also applies to the third cylinder 12#3 in which the though-hole similar to the through-hole 64 is formed in the weight portion located on the side closer to the second cylinder 12#2 that is the adjacent cylinder for the third cylinder 12#3.

Other Embodiments

3-1. Another Example of Shape of Concave Portion and Through-Hole

With regard to the radial direction of the crankshaft 20, the concave portion 48 according to the first embodiment and the through-hole 64 according to the second embodiment are formed so as to overlap the whole gas-vent hole 46#12 when seen from the axial direction of the crankshaft 20. This also applies to the concave portion for the third cylinder 12#3 according to the first embodiment and the through-hole for the third cylinder 12#3 according to the second embodiment. However, with regard to the radial direction of a crankshaft, at least one of the "concave portion" and the "through-hole" according to the present disclosure may alternatively be formed so as to overlap with a part of a gas-vent hole when seen from the axial direction of the crankshaft, instead of the example described above.

3-2. Example of Combination of Concave Portion and Through-Hole

Both of the "concave portion" and the "through-hole" according to the present disclosure may alternatively be combined with each other, instead of the example in which only one of the concave portion 48 and the through-hole 64 is provided similarly to the first and second embodiments described above. That is to say, for example, the "concave portion" may alternatively be formed on a part of a region of a counterweight that is opposed to a gas-vent hole during rotation of a crankshaft, and the "through-hole" may be formed in another part or the remaining portion of the region.

3-3. Example of Application to Center Cylinder (#2) of In-line Three-cylinder Engine According to the first embodiment described above, for balancing the crankshaft 20, the countermeasure that the counterweights 24#1 and 24#3 for the first cylinder 12#1 and the third cylinder 12#3 are made larger than the counterweight 24#2 for the second cylinder 12#2 is taken (this countermeasure is also applied to the counterweights 62 according to the second embodiment). Contrary to this kind of example, an in-line three-cylinder engine may adopt a countermeasure to perform the balancing for each cylinder while installing, in each cylinder, a counterweight having the same size. In this kind of example, at least one of a concave portion and a through-hole as described above may be similarly formed for a weight portion of a counterweight for the center cylinder (#2), which is located on the side closer to its adjacent cylinder (#1 or #3).

3-4. Other Examples of Number of Cylinders of Internal Combustion Engine

According to the first and second embodiments, the examples of in-line three-cylinder internal combustion engines 10 and 60 have been described. However, the internal combustion engine according to the present disclosure may not always be an in-line three-cylinder engine, and may alternatively be an in-line two-cylinder engine (provided that the phase difference of pistons of two cylinders are not 360 degrees), or an internal combustion engine having four or more cylinders (which is not limited to be of the in-line type).

The embodiments and modification examples described above may be combined in other ways than those explicitly described above as required and may be modified in various ways without departing from the scope of the present disclosure.

What is claimed is:

1. An internal combustion engine, comprising:

a cylinder block including a bulkhead formed so as to separate adjacent cylinders;

a crankshaft including a counterweight; and a gas-vent hole which is formed in the bulkhead within a radius of rotation of the counterweight when seen from below a piston bottom-dead-center position and an axial direction of the crankshaft, and which communicates between the adjacent cylinders, wherein the counterweight includes at least one of a concave portion and a through-hole formed at at least a part of a region of the counterweight opposed to the gas-vent hole during rotation of the crankshaft, wherein, in a view along the axial direction of the crankshaft when the counterweight and the gas-vent hole overlap each other, the at least one of the concave portion and the through-hole is spaced radially inwardly from an outer edge of the counterweight, and wherein the concave portion hollows in a direction away from the gas-vent hole, the through-hole penetrating through the counterweight in a direction away from the gas-vent hole.

2. The internal combustion engine according to claim 1, wherein the internal combustion engine is an in-line three-cylinder engine, wherein the internal combustion engine includes a cylinder A arranged at an end of the cylinder block in a cylinder row direction, wherein the at least one of the concave portion and the through-hole is formed at the counterweight for the cylinder A, and wherein the at least one of the concave portion and the through-hole is formed at the counterweight for the cylinder A in its region opposed to the gas-vent hole when a piston position of the cylinder A is within crank angle ranges of 20 to 175 and 220 to 325 degrees after bottom dead center.

3. The internal combustion engine according to claim 1, wherein the internal combustion engine is an in-line three-cylinder engine, wherein the internal combustion engine includes a cylinder A arranged at an end of the cylinder block in a cylinder row direction and a cylinder B arranged at a remaining end of the cylinder block in the cylinder row direction, wherein the at least one of the concave portion and the through-hole is formed at the counterweight for the cylinder B, and wherein the at least one of the concave portion and the through-hole is formed at the counterweight for the cylinder B in its region opposed to the gas-vent hole when a piston position of the cylinder B is within crank angle ranges of −110 to −15 and 75 to 200 degrees after bottom dead center.

4. The internal combustion engine according to claim 1, wherein, when seen from the axial direction of the crankshaft, the at least one of the concave portion and the through-hole is formed so as to extend in an arc shape in a circumferential direction of the crankshaft.

5. The internal combustion engine according to claim 1, wherein, with regard to a radial direction of the crankshaft, the at least one of the concave portion and the through-hole is formed so as to entirely overlap with the gas-vent hole when seen from the axial direction of the crankshaft.

* * * * *